US011690438B2

(12) United States Patent
Rorich

(10) Patent No.: US 11,690,438 B2
(45) Date of Patent: Jul. 4, 2023

(54) BREACHER'S MODULAR TOOL CARRYING SYSTEM

(71) Applicant: Bushido Tactical, LLC, Orlando, FL (US)

(72) Inventor: Wade Rorich, Orlando, FL (US)

(73) Assignee: Bushido Tactical, LLC, Orlando, FL (US)

( * ) Notice: Subject to any disclaimer, the term of this patent is extended or adjusted under 35 U.S.C. 154(b) by 0 days.

(21) Appl. No.: 17/368,949

(22) Filed: Jul. 7, 2021

(65) Prior Publication Data

US 2022/0007818 A1 Jan. 13, 2022

Related U.S. Application Data

(60) Provisional application No. 63/048,768, filed on Jul. 7, 2020.

(51) Int. Cl.

| | |
|---|---|
| ***A45F 3/06*** | (2006.01) |
| ***A45F 3/10*** | (2006.01) |
| ***A45F 3/00*** | (2006.01) |

(52) U.S. Cl.

CPC ..... *A45F 3/06* (2013.01); *A45F 3/10* (2013.01); *A45F 2003/003* (2013.01)

(58) Field of Classification Search

CPC ..... A45F 3/10
USPC ..... 224/628
See application file for complete search history.

(56) References Cited

U.S. PATENT DOCUMENTS

| | | | | | |
|---|---|---|---|---|---|
| 3,957,183 | A * | 5/1976 | Gadberry | B63C 11/02 | 224/628 |
| 4,310,110 | A * | 1/1982 | Dexter | A45F 3/08 | 224/628 |
| 4,848,714 | A * | 7/1989 | Ziaylek, Jr. | A62C 13/78 | 248/313 |
| 4,934,573 | A * | 6/1990 | Jaeger | A45F 3/08 | 224/628 |
| D319,778 | S * | 9/1991 | Ziaylek, Jr. | D8/373 | |
| 5,071,100 | A * | 12/1991 | Sweeny | A62C 13/78 | 248/311.2 |
| 5,190,260 | A * | 3/1993 | Daubenspeck | F24H 9/06 | 248/146 |
| D394,381 | S * | 5/1998 | Ziaylek, Jr. | D8/354 | |
| D415,013 | S * | 10/1999 | Griffiths | D8/354 | |
| 6,220,557 | B1 * | 4/2001 | Ziaylek | F17C 13/084 | 248/316.1 |

(Continued)

FOREIGN PATENT DOCUMENTS

| | | | | |
|---|---|---|---|---|
| CN | 109674189 A * | 4/2019 | A45F 3/06 | |
| EP | 2931079 B1 * | 9/2020 | A41D 1/04 | |

*Primary Examiner* — Justin M Larson

(57) ABSTRACT

Embodiments of the present invention provide a modular tool carrying system and apparatus. In an embodiment of the invention, the modular tool carrying apparatus includes a rigid outer surface and an inner surface opposite the rigid outer surface where the inner surface is configured to be placed against a back of a user. The modular tool carrying apparatus further includes shoulder straps configured to secure the inner surface against the user and a central tool mounting assembly configured to secure one or more tools to the rigid outer surface. The central tool mounting assembly includes a strap configured to secure the tool to the rigid outer surface between parallel brackets mounted to the rigid outer surface.

16 Claims, 3 Drawing Sheets

(56) References Cited

U.S. PATENT DOCUMENTS

D463,728 S * 10/2002 Johnson ..... D12/120
D468,792 S * 1/2003 Jacoway ..... D21/804
6,502,732 B1 * 1/2003 Bonds ..... A45F 3/14
224/628
D500,545 S * 1/2005 Griffiths ..... D21/804
6,857,820 B2 * 2/2005 Jacoway ..... B63C 11/02
405/187
6,920,879 B2 * 7/2005 Haeuser ..... A62B 9/04
128/201.27
6,926,243 B1 * 8/2005 Ziaylek ..... A62B 25/00
248/307
7,021,508 B1 * 4/2006 Aston ..... A45F 3/10
224/628
7,503,535 B2 * 3/2009 Ziaylek ..... A62B 9/04
348/505
D601,076 S * 9/2009 Ziaylek ..... D12/214
8,181,833 B2 * 5/2012 Wangeby ..... A45F 3/14
224/264
8,356,692 B1 * 1/2013 Steck ..... A62B 9/04
182/4
8,608,040 B2 * 12/2013 Cheesman ..... A62B 25/00
224/628
8,678,206 B2 * 3/2014 Kubiniec ..... F41A 23/18
211/64
8,833,624 B2 * 9/2014 Miyamoto ..... A45F 3/08
224/259
D720,531 S * 1/2015 Judson ..... D3/261
10,251,467 B2 * 4/2019 Donhauser ..... A45F 3/12
10,357,097 B1 * 7/2019 Goldberg ..... A45F 3/04
10,463,137 B2 * 11/2019 Simione ..... A45F 3/08
10,470,553 B1 * 11/2019 Gonzalez ..... A45F 3/08
11,110,867 B2 * 9/2021 Franklin ..... A47F 7/0028
11,229,276 B2 * 1/2022 Simione ..... A45F 3/10
2003/0000974 A1 * 1/2003 McUmber ..... A45F 3/10
224/628
2005/0000993 A1 * 1/2005 Moskun ..... A45F 3/08
224/628
2006/0102675 A1 * 5/2006 Bezak ..... A45F 3/047
224/628
2006/0266781 A1 * 11/2006 Howell ..... A45F 3/08
224/628
2008/0142562 A1 * 6/2008 Cheng ..... A45F 3/08
224/628
2015/0320184 A1 * 11/2015 Bal ..... A45F 3/00
224/261
2017/0143106 A1 * 5/2017 Kotter ..... A45F 3/10
2021/0112953 A1 * 4/2021 Simione ..... B60P 7/0807
2021/0274859 A1 * 9/2021 Saggio ..... A45F 3/08
2021/0386181 A1 * 12/2021 Farmer, II ..... A45F 3/08
2022/0007818 A1 * 1/2022 Rorich ..... A45F 3/08

* cited by examiner

BREACHER'S MODULAR TOOL CARRYING SYSTEM

CROSS-REFERENCE TO RELATED APPLICATIONS

This application claims the benefit of U.S. Provisional Application No. 63/048,768, filed Jul. 7, 2020, entitled "BREACHER'S MODULAR TOOL CARRYING SYSTEM," the entirety of which is incorporated herein by reference.

BACKGROUND OF THE INVENTION

Field of the Invention

This invention relates to tool carrying systems and more particularly to a modular tool carrying system for breacher, law enforcement, first responder, special forces, and military use.

Description of the Related Art

Law enforcement, breachers, first responders, special forces, and military personnel often require manual and power tools (gas and battery) during the course of various operations. Many of these tools are large and cumbersome. And other tools do not fit into current uniform mounting systems. However, these personnel also require free use of their hands during these operations. These personnel may also engage in inserting and extracting and other entry/rescue operations requiring personnel to climb, repel, parachute, fast-roping or engage in other activities which benefit from keeping the operator's hands available and enhance their personal safety.

Although one may attempt to carry large tools in a normal operations backpack, the utilizing slings or carabiners, tools may easily move around and expose the individual to dangerous portions of the tools, such as saw blades or cutting tools. Furthermore, when a large power tool moves around, the tool may throw the individual off balance.

Therefore, there exists a need for personnel to be able to securely carry large tools during their operations while allowing free use of their hands without interfering with easy balance of the operator.

BRIEF SUMMARY OF THE INVENTION

Embodiments of the present invention address deficiencies of the art in respect to modular carriers for law enforcement (and other) use and provide a novel and non-obvious modular tool carrying apparatus and system. In an embodiment of the invention, a modular tool carrying apparatus includes a rigid outer surface and an inner surface opposite the rigid outer surface where the inner surface is configured to be placed facing a back of a user. The modular tool carrying apparatus further includes shoulder straps configured to secure the inner surface against the user and a central tool mounting assembly configured to secure one or more tools to the rigid outer surface. The central tool mounting assembly includes a strap configured to secure the tool to the rigid outer surface between parallel brackets mounted to the rigid outer surface.

In one aspect of the embodiment, the rigid outer surface is substantially flat. In another aspect of the embodiment, the thickness of the rigid outer surface to the inner surface is about 0.3 inches. In another aspect of the embodiment, the rigid outer surface is made from a sheet of thermoplastic material. In another aspect of the embodiment, the one or more tools to which the central tool mounting assembly is configured to secure are large power tools. In another aspect of the embodiment, the rigid outer surface includes slots to secure the shoulder straps to the rigid outer surface.

In yet another aspect of the embodiment, the rigid outer surface includes at least one vertical securing bracket located beneath the strap and parallel brackets on the rigid outer surface. In another aspect of the embodiment, the at least one vertical securing bracket is adjustable in vertical distance to the strap and parallel brackets on the rigid outer surface. In another aspect of the embodiment, the at least one vertical securing bracket is adjustable in horizontal distance to the strap and parallel brackets on the rigid outer surface. In another aspect of the embodiment, the rigid outer surface includes at least one horizontal securing bracket located beneath the strap and parallel brackets on the rigid outer surface. In another aspect of the embodiment, the at least one horizontal securing bracket is adjustable in horizontal distance to the strap and parallel brackets on the rigid outer surface. In another aspect of the embodiment, the rigid outer surface includes a second horizontal securing bracket and the horizontal securing brackets are adjustable in horizontal and vertical distance to each other on the rigid outer surface.

In even yet another aspect of the embodiment, the rigid outer surface further includes a side tool mounting assembly mounted on each side of the central tool mounting assembly adjacent a distal edge of the rigid outer surface where each side tool mounting assembly is configured to secure one or more tools to the rigid outer surface. In another aspect of the embodiment, each side tool mounting assembly each include a strap configured to secure the tool to the rigid outer surface between parallel brackets mounted to the rigid outer surface. In another aspect of the embodiment, each side tool mounting assembly includes a tool securing bracket mounted to the rigid outer surface beneath its strap and parallel brackets. In another aspect of the embodiment, the one or more tools to which each side tool mounting assembly is configured to secure are hand tools.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the present invention provide for a modular tool carrying apparatus and system that is configured to secure tools against the modular tool carrying apparatus' rigid outer surface. The rigid outer surface may include slots or mounting holes in order to allow a straps, brackets, or tool mounting assemblies to secure a large tool against the rigid outer surface of the modular tool carrying system. The rigid outer surface may further include additional mounting holes or slots on each side of the rigid outer surface in order to allow a straps, brackets, or tool mounting assemblies to secure smaller hand tools against the rigid outer surface of the modular tool carrying system. There may be additional slots and mounting holes to mount support brackets to keep the large tools and smaller hand tools securely in position. The modular tool carrying system may include additional slots to allow shoulder straps that secure the tool carrying system to the user's back. The modular tool carrying system may be configured to fit over another layer, such as a ballistic armor layer. In this way, the end user can easily access large power tools and smaller hand tools for breaching that are secured to their back allowing free use of their hands in high risk operations.

Figure 1A:
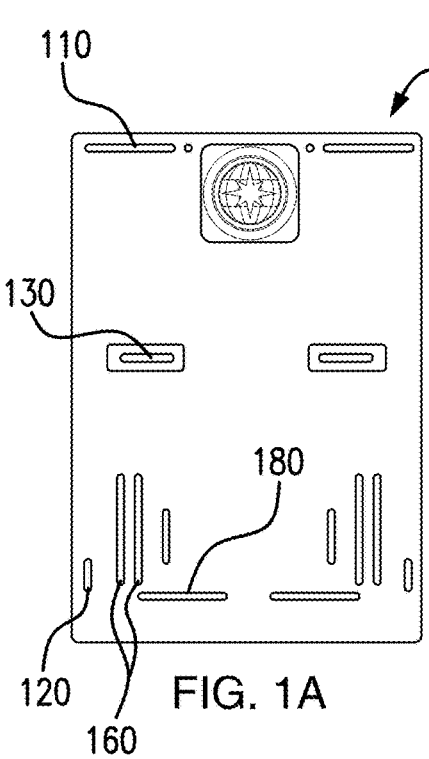
FIGS. 1A-1C are a front view, side view, and rear view, respectively, of a pictorial illustration of a modular tool carrying system in accordance with an embodiment of this invention.
Figure 1B:
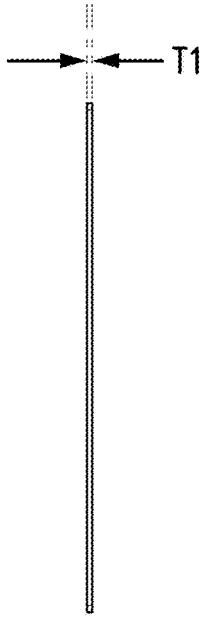
Figure 1C:
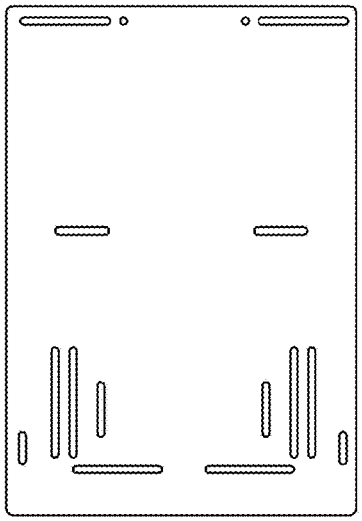
Figure 2A:
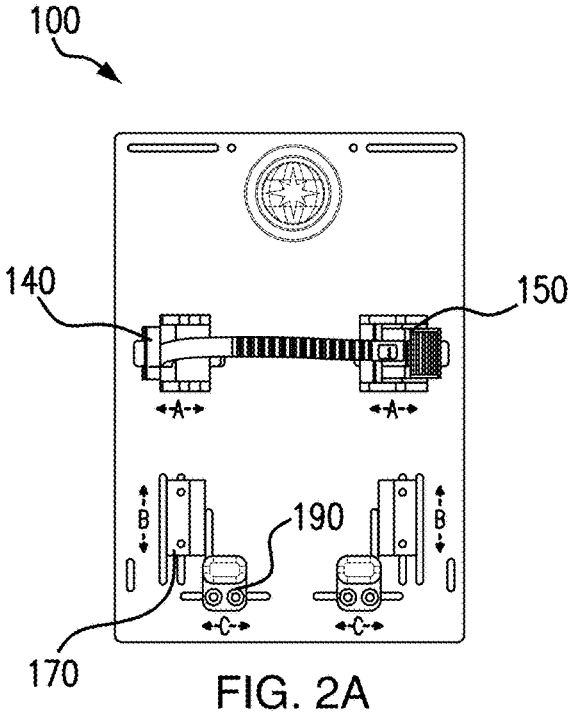
FIGS. 2A-2B are front views of a pictorial illustration of a modular tool carrying system in accordance with an embodiment of this invention.
Figure 2B:
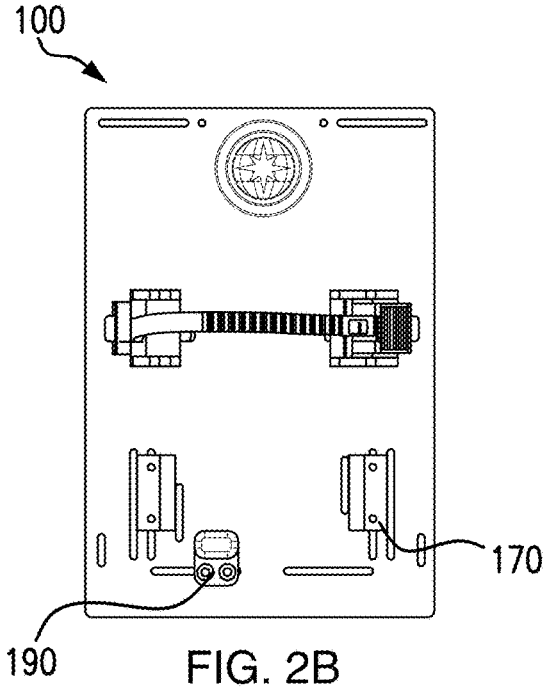
Figure 5A:
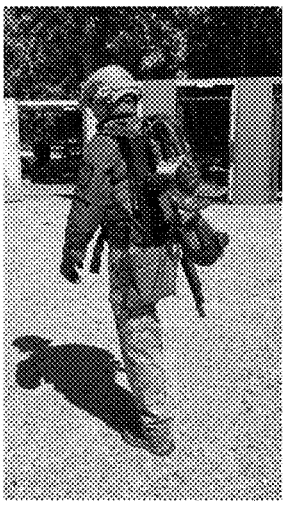
FIGS. 5A-5C are pictorial illustrations of a modular tool carrying system in operation in accordance with embodiments of this invention; and, FIGS. 6A-6C are pictorial illustrations of a modular tool carrying system in operation in accordance with embodiments of this invention.
Figure 5B:
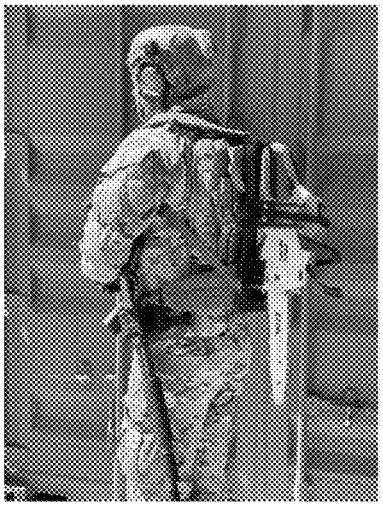
Figure 5C:
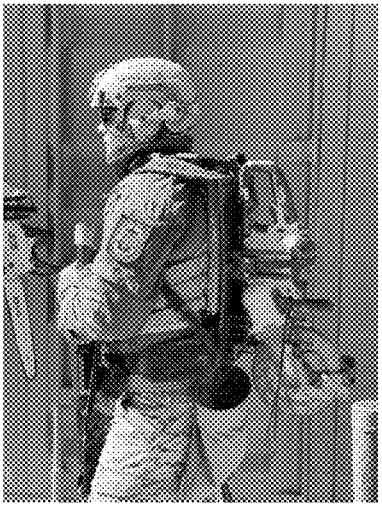

In further illustration, FIGS. 1A-1C pictorially show a modular tool carrying apparatus or system in accordance with an embodiment of this invention without the various mounting assemblies and support brackets attached and FIGS. 2A-2B show the modular tool carrying system of FIGS. 1A-1C with the various mounting assemblies and support brackets attached. FIGS. 5A-5C show the modular tool carrying system of FIGS. 1A-1C and 1A-1B in operation. As can be seen, the modular tool carrying system includes a rigid outer surface 100 that is substantially flat on which large power tools are secured. The rigid outer surface may be made from a lightweight, rigid materials, such as sheets of thermoplastic material or lightweight metals, and may be of a thickness T1 of approximately 0.312 inches in order to maintain the lightweight characteristics of the system. Although a thickness of 0.312 inches is shown, any thickness is within the scope of this invention. Further, the rigid outer surface is shown as rectangular in shape, however any shape that maintains the rigid, lightweight and easily accessible nature of the modular tool carrying apparatus is within the scope of the invention.

The rigid outer surface 100 includes upper shoulder strap slots 110 and lower shoulder strap slots 120 to attach shoulder straps to secure the inner surface (the surface shown in FIG. 1C), which would be facing the back of an end user and opposite the rigid outer surface, to the back of an end user. The rigid outer surface further includes central tool mounting assembly slots 130 for the central tool mounting assembly 140. The central tool mounting assembly includes strap mechanism 150 with the strap and parallel brackets to limit lateral and vertical movement of the tool. Although Fast Lok straps are shown in the figures, any straps, such as ratchet straps, or other tool mounting assemblies may be utilized to secure the larger tools the rigid outer surface of the modular tool carrying system. The tool secured by the central mounting assembly is a large power tool, such as the electric hydraulic breaching power tools, as shown in FIGS. 5A-6C.

Further, the rigid outer surface 100 may include additional slots or mounting holes to allow additional brackets to be mounted to restrict side to side movement and roll, pitch and yaw of the large power tools. The rigid outer surface may include horizontal securing bracket slot(s) 160 to attach horizontal securing bracket(s) 170 to limit horizontal and rotational movement of the power tool about the rigid outer surface. The rigid outer surface may also include vertical securing bracket slot(s) 180 to attach vertical securing bracket(s) 190 to limit vertical and rotational movement of the power tool about this rigid outer surface. The horizontal bracket(s) 170 and vertical bracket(s) 180 are mounted below or beneath the central tool mounting assembly towards the bottom edge of the rigid outer surface to limit the rotational movement of the tool. As shown in FIGS. 2A and 2B the horizontal bracket(s) and vertical bracket(s) may be adjustable in horizontal and vertical distance to secure the tool based on the size and shape of the specific tool by moving the bracket within its slot or by moving the bracket to other mounting slots or holes. Further, as can be seen in FIG. 2B, the horizontal securing brackets are adjustable in horizontal and vertical distance to each other on the rigid outer surface.

Figure 3A:
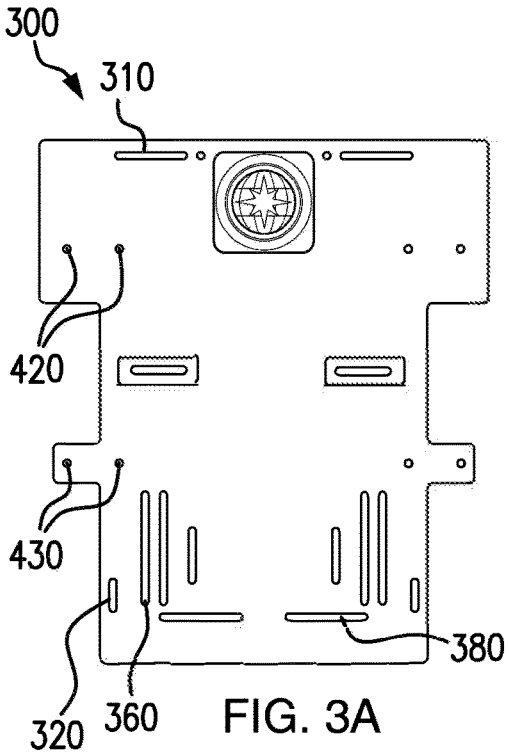
FIGS. 3A-3C are a front view, side view, and rear view, respectively, of a pictorial illustration of a modular tool carrying system in accordance with an embodiment of this invention.
Figure 3B:
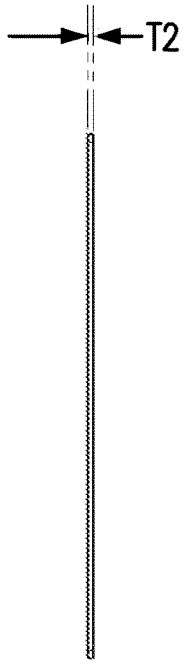
Figure 3C:
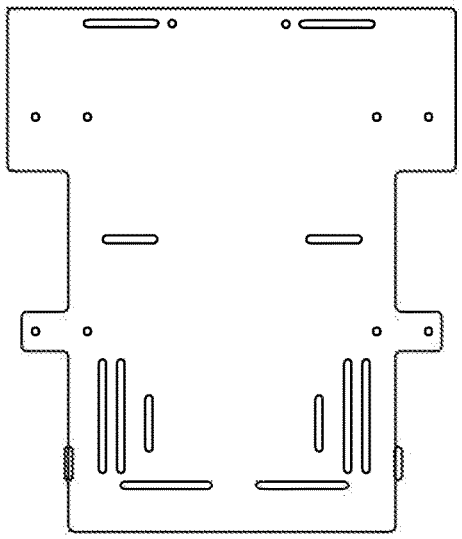
Figure 4A:
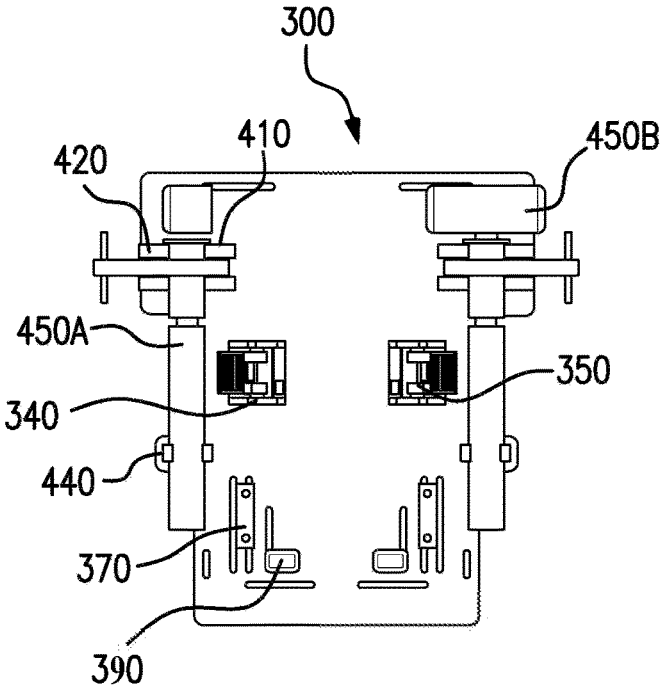
FIG. 4A is a front view of a pictorial illustration of a modular tool carrying system in accordance with an embodiment of this invention.
Figure 4B:
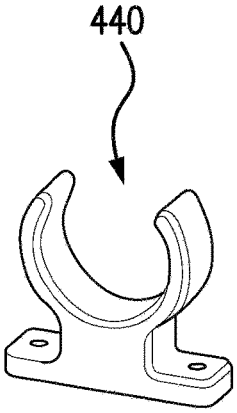
FIG. 4B is a schematic illustration of an exemplary side tool support bracket of a modular tool carrying system in accordance with an embodiment of this invention.
Figure 6A:
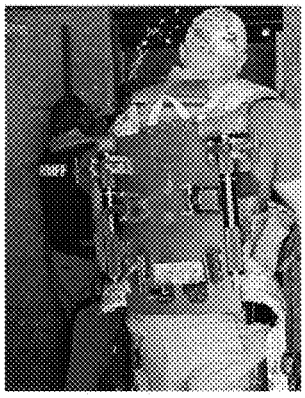
Figure 6B:
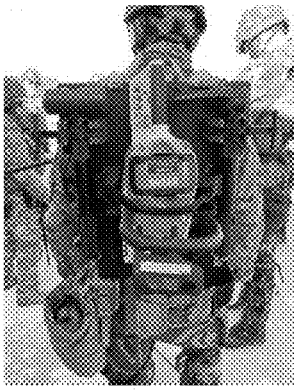
Figure 6C:
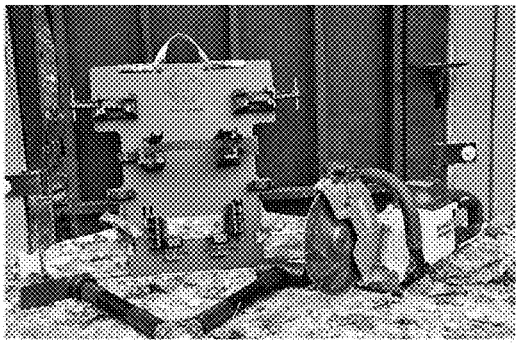

FIGS. 3A-3C pictorially show a modular tool carrying apparatus or system in accordance with another embodiment of this invention without the various mounting assemblies and support brackets attached. FIG. 4A shows the modular tool carrying system of FIGS. 3A-3C with the various mounting assemblies and support brackets attached. FIG. 4B shows an exemplary side tool support bracket of FIGS. 3A-3C and 4A. FIGS. 6A-6C show the modular tool carrying system of FIGS. 3A-3C and 4A in operation. FIGS. 3A-3C, 4A and 6A-6C show a modular tool carrying system that allows additional tools to be secured by tool support brackets near the side edges of the rigid outer surface.

Similar to the embodiment described above, the modular tool carrying apparatus or system includes a rigid outer surface 300 that is substantially flat on which large power tools are secured. The rigid outer surface may be made from a lightweight, rigid material, such as sheets of thermoplastic material or metals, and may be of a thickness T2 of approximately 0.312 inches in order to maintain the lightweight characteristics of the system. Although a thickness of 0.312 inches is shown, any thickness is within the scope of this invention. Further, the rigid outer surface is shown as rectangular in shape with protrusions for the side support brackets, however any shape that maintains the rigid, lightweight and easily accessible nature of the modular tool carrying apparatus is within the scope of the invention.

Also, similar to the embodiment described above, the rigid outer surface 300 includes upper shoulder strap slots 310 and lower shoulder strap slots 320 to attach shoulder straps to secure the inner surface (the surface shown in FIG. 3C), which would be facing the back of an end user and opposite the rigid outer surface, to the back of an end user. The rigid outer surface further includes central tool mounting assembly slots 330 for the central tool mounting assembly 340. The central tool mounting assembly includes strap mechanism 350 with the strap and parallel brackets to limit lateral and vertical movement of the tool. Although fast lok straps are shown in the figures, any straps, such as ratchet straps, or other tool mounting assemblies may be utilized to secure the larger tools the rigid outer surface of the modular tool carrying system. The tool secured by the central mounting assembly is a large power tool, such as the electric hydraulic breaching power tools, as shown in FIGS. 5A-6C.

Further, similar to the embodiment described above, the rigid outer surface 300 may include additional slots or mounting holes to allow additional brackets to be mounted to restrict side to side movement and roll, pitch and yaw of the large power tools. The rigid outer surface may include horizontal securing bracket slot(s) 360 to attach horizontal securing bracket(s) 370 to limit horizontal and rotational movement of the power tool about the rigid outer surface. The rigid outer surface may also include vertical securing bracket slot(s) 380 to attach vertical securing bracket(s) 390 to limit vertical and rotational movement of the power tool about this rigid outer surface. The horizontal bracket(s) 370 and vertical bracket(s) 380 are mounted below or beneath the central tool mounting assembly towards the bottom edge of the rigid outer surface to limit the rotational movement of the tool. As previously shown in FIG. 2B, the horizontal bracket(s) and vertical bracket(s) may be adjustable in horizontal and vertical distance to secure the tool based on the size and shape of the specific tool by moving the bracket within its slot or by moving the bracket to other mounting slots or holes. Further, as previously seen in FIG. 2B, the horizontal securing brackets are adjustable in horizontal and vertical distance to each other on the rigid outer surface.

In addition to the central tool mounting assembly 340, the rigid outer surface 300 may include upper side tool support bracket mounting holes or slots 400 for attaching side tool mounting assembly 410 on each of the sides of the rigid outer surface towards the distal side edges of the rigid outer surface. The side tool mounting assemblies 410 each include strap mechanism 420 with its own strap and parallel brackets to limit lateral and vertical movement of the tool. Similar to the central mounting assembly, although Fast Lok straps are shown in the figures, any straps, such as ratchet straps, or other tool mounting assemblies may be utilized to secure the smaller hand breaching tools 450A and 450B to the rigid outer surface of the modular tool carrying system. The tool secured by the side mounting assemblies are tools smaller than electric hydraulic breaching power tools mounted to the central tool mounting assembly, such as smaller power tools or hand tools for breaching as shown in FIGS. 6A-6C. The rigid outer surface may also include lower side tool support bracket mounting holes or slots 430 for mounting the side tool supports or securing brackets 440 that hold side tools 450A and 450B to limit the rotational movement of the tool. The side tool support 440 is mounted below or beneath the its respective side mounting assembly towards the bottom edge of the rigid outer surface to limit the rotational movement of the tool.

FIGS. 5A-5C and 6A-6C show the modular tool apparatus or system in operation. The modular tool carrying system is worn by the user reducing the risk of the large, cumbersome and dangerous breaching tools from moving around and injuring the user. The figures shown that the supports and straps of the mounting assemblies can be adjusted to secure different tools against the rigid outer surface. FIGS. 5A-6C show that the modular tool carrying system may be worn against the uniform of the user and show that the modular tool carrying system may be configured to be worn over a ballistic armor layer worn by the user. As can be seen, the modular tool carrying apparatus or system provides a rigid, lightweight and easily accessible apparatus for an end user to secure and easily access breaching tools while allowing free use of their hands in high risk operations.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

I claim:

1. A modular tool carrying apparatus comprising:

a rigid outer surface and an inner surface opposite the rigid outer surface, the inner surface configured to be placed against a back of a user;

shoulder straps configured to secure the inner surface against the user;

a central tool mounting assembly configured to secure one or more tools to the rigid outer surface, the central tool mounting assembly comprising:

a strap configured to secure at least one tool of the one or more tools to the rigid outer surface between parallel brackets mounted to the rigid outer surface, the parallel brackets each being movable towards and away from each other in a proximal-to-distal direction; and at least one horizontal securing bracket configured to limit horizontal and rotational movement of the secured at least one tool;

at least one vertical securing bracket configured to limit vertical movement of the secured at least one tool;

a side tool mounting assembly mounted on each side of the central tool mounting assembly adjacent a distal edge of the rigid outer surface, each side tool mounting assembly being configured to releasably secure one or more tools to the rigid outer surface; and wherein each side tool mounting assembly comprises a strap configured to secure the tool to the rigid outer surface between parallel brackets mounted to the rigid outer surface.

2. The modular tool carrying apparatus of claim 1, wherein the rigid outer surface is flat.

3. The modular tool carrying apparatus of claim 2, wherein the thickness of the rigid outer surface to the inner surface is less than 0.312 inches.

4. The modular tool carrying apparatus of claim 3, wherein the rigid outer surface is made from a sheet of thermoplastic material.

5. The modular tool carrying apparatus of claim 3, wherein the one or more tools to which the central tool mounting assembly is configured to secure comprise large power tools.

6. The modular tool carrying apparatus of claim 1, wherein the rigid outer surface comprises slots to secure the shoulder straps to the rigid outer surface.

7. The modular tool carrying apparatus of claim 1, wherein the at least one vertical securing bracket is located beneath the strap and parallel brackets on the rigid outer surface.

8. The modular tool carrying apparatus of claim 7, wherein the at least one horizontal securing bracket is adjustable in a vertical direction along an axis perpendicular to an axis defined by the strap and parallel brackets on the rigid outer surface.

9. The modular tool carrying apparatus of claim 8, wherein the at least one vertical securing bracket is adjustable in horizontal direction along an access parallel to the axis defined by the strap and parallel brackets on the rigid outer surface.

10. The modular tool carrying apparatus of claim 1, wherein the at least one horizontal securing bracket is located beneath the strap and parallel brackets on the rigid outer surface.

11. The modular tool carrying apparatus of claim 10, wherein the at least one horizontal securing bracket is adjustable in a vertical direction along an axis perpendicular to an axis defined by the strap and parallel brackets on the rigid outer surface.

12. The modular tool carrying apparatus of claim 10, wherein the rigid outer surface comprises a second horizontal securing bracket and the horizontal securing brackets are each adjustable in a vertical distance with respect to each other on the rigid outer surface.

13. The modular tool carrying apparatus of claim 1, wherein each side tool mounting assembly comprises a tool securing bracket mounted to the rigid outer surface beneath its strap and parallel brackets.

14. The modular tool carrying apparatus of claim 1, wherein the one or more tools to which each side tool mounting assembly is configured to secure comprise hand tools.

15. The modular tool carrying apparatus of claim 1, wherein the tool is a power tool.

16. A modular tool carrying apparatus for simultaneously carrying tools of different sizes and shapes, comprising:

a rigid outer surface and an inner surface opposite the rigid outer surface, the inner surface configured to be placed against a back of a user;

shoulder straps configured to secure the inner surface against the user; and a plurality of tool mounting assemblies configured to releasably secure one or more tools to the rigid outer surface, the plurality of tool mounting assemblies including:

a plurality of side tool mounting assemblies, each of the plurality of side tool mounting assemblies being proximate to a respective distal side edge of the rigid outer surface; and a central tool mounting assembly configured to releasably secure one or more tools to the rigid outer surface between the plurality of side tool mounting assemblies; and wherein each of the plurality of tool mounting assemblies includes a fastener configured to releasably secure the tool to the rigid outer surface between parallel brackets mounted to the rigid outer surface.

* * * * *